United States Patent [19]

Reale

[11] 4,228,856

[45] Oct. 21, 1980

[54] PROCESS FOR RECOVERING VISCOUS, COMBUSTIBLE MATERIAL

[76] Inventor: Lucio V. Reale, 1827 - 46th St. SE., Calgary, Alberta, Canada

[21] Appl. No.: 15,562

[22] Filed: Feb. 26, 1979

[51] Int. Cl.[3] ..... E21B 43/243

[52] U.S. Cl. ..... 166/256; 166/257; 166/272; 166/302

[58] Field of Search ..... 166/256, 257, 259, 260, 166/272, 302, 57, 63, 245; 299/2

[56] References Cited

U.S. PATENT DOCUMENTS

| | | | |
|---|---|---|---|
| 947,608 | 1/1910 | Betts | 299/2 |
| 2,761,663 | 9/1956 | Gerdetz | 299/2 |
| 2,874,777 | 2/1959 | Tadema | 166/257 X |
| 2,930,598 | 3/1960 | Parker | 166/257 |
| 3,017,168 | 1/1962 | Carr | 166/256 X |
| 3,191,679 | 6/1965 | Miller | 166/257 |
| 3,240,270 | 3/1966 | Marx | 166/256 X |
| 3,457,995 | 7/1969 | Cornelius et al. | 166/260 |
| 3,599,714 | 8/1971 | Messman et al. | 166/258 |
| 3,933,447 | 1/1976 | Pasini et al. | 166/256 X |
| 4,092,052 | 5/1978 | Terry | 299/2 |

FOREIGN PATENT DOCUMENTS

| | | | |
|---|---|---|---|
| 812573 | 9/1971 | Fed. Rep. of Germany | 299/2 |

*Primary Examiner*—Stephen J. Novosad

*Assistant Examiner*—George A. Suchfield

*Attorney, Agent, or Firm*—Smyth, Pavitt, Siegemund, Jones & Martella

[57] ABSTRACT

A process for recovering a viscous, combustible material, for example tar from a tar sand or oil and bitumen from heavy oil, from a sub-surface deposit of the material. The process comprises forming a substantially vertical main bore into the deposit and igniting the deposit adjacent the base of the bore. Such ignition may be carried out by any means, for example by burning a fuel, by an explosion or by a laser beam. Generally the ignition is assisted until such time as the material in the deposit is ignited. A supply of air is arranged to the ignition site so that a self-sustaining combustion takes place in the bore once the ignition is properly established. This combustion is supported by a natural draft generated by the combustion. The gaseous products of the combustion can leave the bore and the heat of the combustion and of the gaseous products of combustion as they leave the bore liquefy the material in the deposit. This heat can also be used to develop steam from water supplied to a vessel in the bore, which steam also assists in liquefying the material. The liquefied material is extracted from the bore. The process avoids the high pressure requirements of the prior art processes and, in particular, does not need high fluid pressure to drive the liquefied products from one bore to another bore.

22 Claims, 12 Drawing Figures

PROCESS FOR RECOVERING VISCOUS, COMBUSTIBLE MATERIAL

FIELD OF THE INVENTION

The present invention relates to a process of recovery of a viscous combustible material e.g. tar from tar-sand deposits and bituminous oil extraction. The present invention provides a process by which underground combustion is used to perform the melting and thinning of the material in a novel manner. The underground combustion, once started, becomes a self-sustaining combustion process.

DESCRIPTION OF THE PRIOR ART

Underground combustion process are known and many of them use the underground combustion of part of the oil to liquefy the remaining oil in the deposit. The main problem encountered is the supply of the air needed to maintain the proper combustion. Also the continuity of the natural draft and exhaustion of the combustion dry gases is missing with the existing processes.

Known procedures have involved the formation of one or more bore holes, spaced some distance from each other. Some of the holes act as injection wells and others as recovery wells. Air, steam or other gas is injected under high pressure in order to push the melted oil from the injection well to the recovery well directly through the mass of solid tar or oil. In some cases compressed air is injected to maintain a fire started within the injection well and gradually pushed away from the injection well. The fire travels, always under pressure, for about one year until it reaches the recovery well with its volume of melted oil. These holes are vertical only.

Where interconnected inclined bored holes are used the known processes inject air, steam or gases into many of them using one as the recovery hole. As is evident there is no combustion continuity, and here also the melted oil travels to the recovery well, pushed by the injected, pressurized elements, e.g. air, gases or steam.

SUMMARY OF THE INVENTION

The present invention differs from prior processes by the provision of self-sustaining combustion process, a natural draft effect to provide the make-up air needed for the underground combustion and to maintain a chimney flue effect, by the use of the combustion products to melt the required tar or oil deposit and, in a preferred embodiment, by the particular casing utilized.

In the present invention the make-up air required to start, and maintain the underground combustion is provided by natural means, that is by a natural draft. The "chimney stack" effect is used to convey the gaseous products of the underground combustion up and out of the ground and the natural flue effect of hot escaping gases is used to provide the heat required to melt and thin additional tar or bituminous substances.

In the present invention use is made of the effect that heated air expands and the weight per unit volume becomes less than cooler air. This forces the warmer air to rise as the denser, cool air flows down into the combustion zone to take its place. Further the pressure inside the chimney, near the base or combustion chamber, is less than that of the outside air. This pressure differential is known as the draft effect of the chimney, promoting the flow of air through the combustion chamber and up the chimney.

In the present invention a combustible material, e.g. tar sand mixture or bituminuous oil deposit, is ignited to start the self-sustaining combustion process. The preliminary ignition of the deposit can be obtained by any known means, such as gas, inflammable liquids, fuels, using a laser beam and using any kind of explosion.

The present process is applicable to the recovery of tar or oil from shallow deposits and deep deposits. It is also intended to be used on large man-made deposits of tar sand mixture, e.g. in mounds or piles, and formed of tar sand mined from its natural underground location.

In one aspect the present invention provides a method in which a vertical bore hole is interconnected by an inclined bore hole, to provide the funnelling of the supply of combustion air and the exhaustion of the products of the combustion as dry gases.

The vertical bore hole acts as the chimney of the system, and also as the carrier of the combustion gases using the natural flue effect. The vertical bore is used to propagate the heat need to melt the surrounding tar or oil material. The vertical bore becomes a natural combustion chamber that rises with the upward movement of the fire.

When the formation of the deposit requires the use of a casing, the particular casing used in the bore of the vertical hole should be perforated with holes or openings, for example occupying up to 85% of the casing surface. This allows the hot gases to pass through the openings and come in contact with the tar or oil to be melted by the absorbed heat. The casing is made of resilient, heat resistant materials, like steel or other structural material.

In the present invention the inclined bored hole is the one selected to act as the carrier of the make-up air required for the combustion process. This inclined bore hole uses a specially designed casing, being properly insulated and cooled, to maintain the inflow of air to the combustion chamber as cool as possible to maintain a natural draft of air. The casing is made of fire resistant and structurally sound material, for example asbestos.

BRIEF DESCRIPTION OF DRAWINGS

The invention is illustrated, merely by way of example, in the accompanying drawings, in which:

FIGS. 9 and 10 show further aspects of the invention.

In FIGS. 11 and 12 the same reference numerals are used as in FIGS. 9 and 10 for similar parts.

DESCRIPTION OF THE PREFERRED EMBODIMENTS

Figures 1, 2, 3, 4, 5, 6:
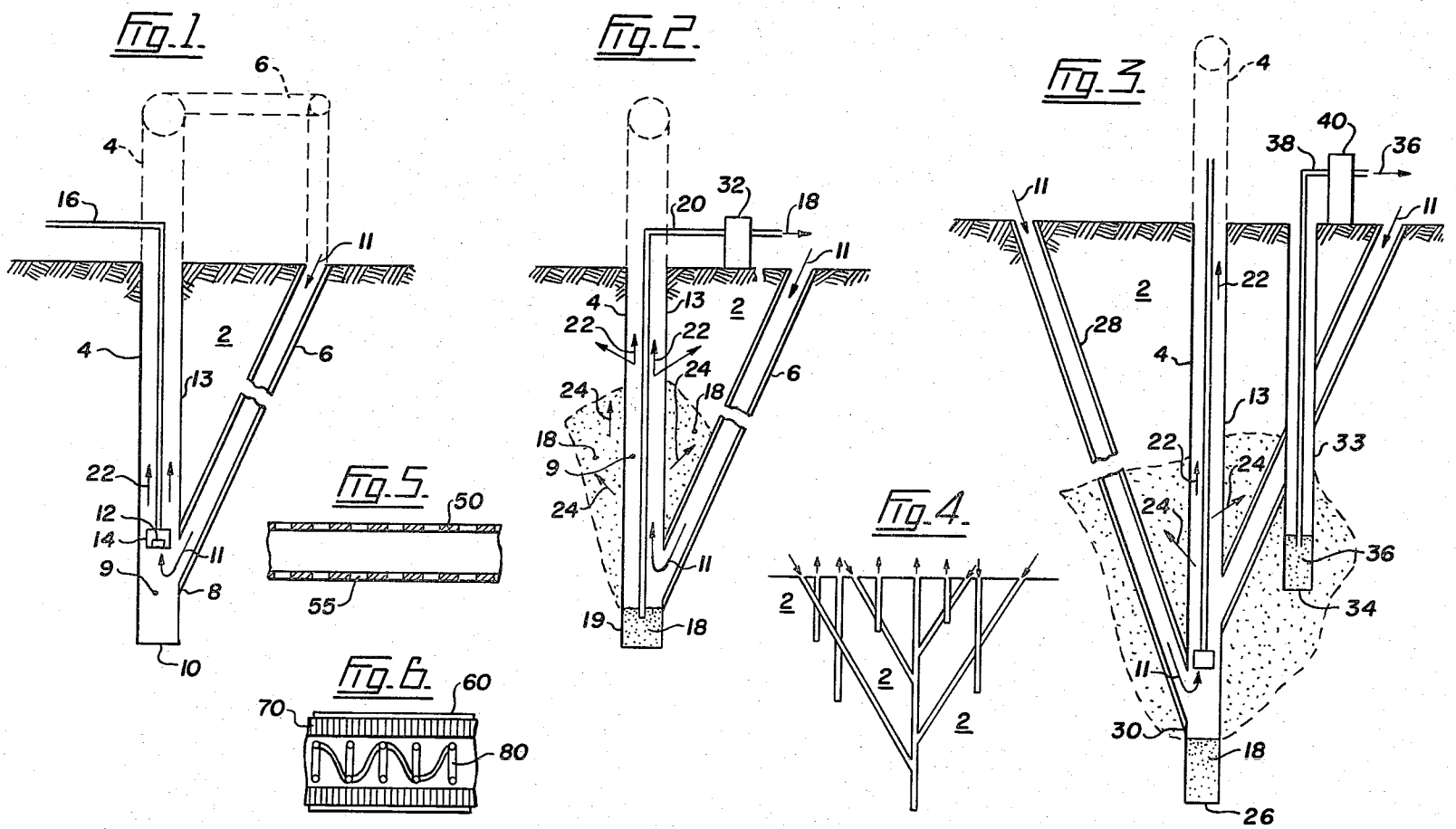
FIGS. 1 to 4 show steps in one method according to the present invention.
FIG. 5 shows a detail of a pipe useful in the method illustrated in FIGS. 1 to 4.
FIG. 6 shows a detail of another pipe useful in the method illustrated in FIGS. 1 to 4.

Referring to the drawings, FIGS. 1 to 6 show the recovery of viscous combustible material, for example, tar and oil within a natural draft depth, and the formation of a natural flue and chimney effect. The arrangement is to provide self-sustaining combustion.

Referring to FIG. 1, into a buried deposit 2, for example a tar sand, a well is formed comprising a main bore 4, substantially vertical, and a second bore 6 inclined to the main bore 2 and meeting the main bore 4 at a junction 8 above the bottom 10 of the main bore 4.

The formation of the main bore 4 and the inclined second bore 6 is to create a self-combustion pathway in which an ignition device 12 comprising a burner head 14, and a pipe 16 provide the required fire starting equipment.

A combustible material is fed through the pipe 16 to the burner head 14 and is then ignited. The ignition is carried on until the tar deposit in the vicinity of the junction 8 ignites and establishes a natural draft flow of fresh, cooler air from the outside as required to maintain the combustion process. It will be understood that any alternative method of starting the combustion may be used, for example, an explosion, a laser beam or electrical means.

At the start of the combustion process a combustion chamber 9 is defined by the space comprised by the bottom of the main bore 4, the ignition device 12, and burner 14.

The arrows show inflow air draft 11 and gaseous product of combustion 22, conveyed up and out, by a chimney stack effect provided by the portion 13 of the main bore 4.

FIG. 2 shows a further step of the process in which, once the ignition is started and a convection draft or inflow of air is established, the pipe 16, the burner head 14 and the ignition device 12, are withdrawn from the main bore 4. The fire 24 propagates upwardly and away from the main bore 4, melting the material 18, which by gravity is collected at the bottom part 19 of the bore 4.

The gaseous products of combustion 22, being very hot, supply additional heat to the contacted material, e.g. the tar surface, melting additional material 18 which also flows down to the collector part 19 by gravity. The melted tar 18 is then pumped out of the bore hole 4 using a suitable pump 32 and a pipe 20.

Thus with a two bore hole system, after a relatively short initial period of assisted ignition, the combustion is self-maintained, advancing the fire in all directions. A natural draft of inflow air is obtained and the draft and flue effect operate within the bore hole itself, which becomes the natural chimney of the system. The hot gases are further utilized to melt additional tar while escaping out into the flue stream. In an embodiment not illustrated this melting may be assisted by feeding water down a pipe to a vessel having perforations in its upper walls and positioned typically just above the junction of bores 4 and 6. The heat within the bore hole 4 boils the water to form steam which assists melting of the tar.

FIGS. 3 and 4 illustrate that the well shown in FIG. 2 may be expanded to cover larger surfaces and deeper deposits. In FIG. 3, the original bore hole 4 is rebored to a greater depth to form a new base 26. A further second bore 28 is then formed. It is then necessary to re-ignite the part of the deposit 2 in the vicinity of the junction 30 between the main bore 4 and the further inclined bore 28. Further, as indicated to the right of FIG. 3, an additional vertical bore hole 33 is formed within the area adjacent the second inclined bore hole 6 and it is made to extend below the junction level 8 of the second inclined bore 6 to form a lever level base 34 from which additional melted tar can be pumped out.

The bore hole 33 does not intersect the inclined bore hole 6. It merely acts as a heat reservoir for melting tar.

In FIG. 3, the melted tar 36 can be pumped through pipe 38 under the influence of pump 40. This arrangement may be carried on, as shown diagrammatically in FIG. 4, until all the available material in the deposit is removed.

FIG. 5 illustrates a perforate tube 50 used to case the vertically bored hole when the type of material forming the deposit is not sufficiently compacted to avoid cave-in. The tube 50 may be made of resilient, heat-resistant material and is provided with a plurality of holes 55 to allow for the passage and propagation of flames and hot gases conveyed up by the flue effect. The perforated tube 50 serves also as a stack or chimney within the whole system.

FIG. 6 illustrates a solid tube 60 used to case the inclined bore hole. Tube 60 may be made of resilient, heat-resistant material that retains as little heat as possible, e.g. asbestos. The tube 60 has an inner layer of insulation 70 and cooling coils 80. The tube 60 is used to carry down the make-up air or to act as carrier of the draft flow.

Figure 7:
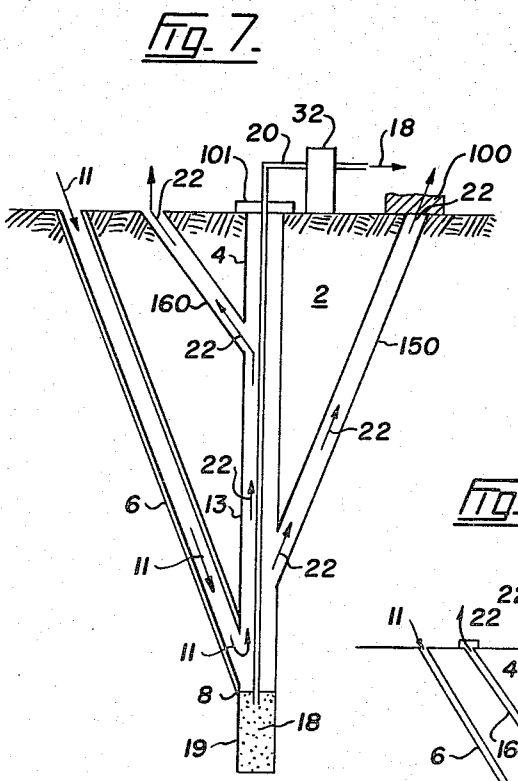

FIG. 7 shows that the natural combustion obtained in the system in FIG. 2 can obtain a complete use of the hot gases produced by the underground combustion if a branching of complementary exhaust holes are added progressively into the system. After the holes 4 and 6 have been used to melt tar by the heat developed by natural combustion, bore hole 4 is capped with a cap 101 that permits the passage of the pipe 20 introduced to extract the melted tar 18. Another inclined hole 150 is bored to create an additional exhaust hole through which the hot gases will escape and be exhausted by a natural chimney and flue effect. The additional heat will melt additional tar and as indicated above, can be used to generate steam. The melted tar flows into the collector 19 from where it is extracted by means of the pipe 20, operated by the pump 32. When it is convenient the bore hole 150 is also capped and an additional inclined hole 160 is bored. The whole process is then repeated with the variant that the additional exhaust hole 180, bored vertically and intended to meet the previous bores, are added to create more and more exhaust chimnies to use the produced heat to the maximum possible extent.

Figure 8:
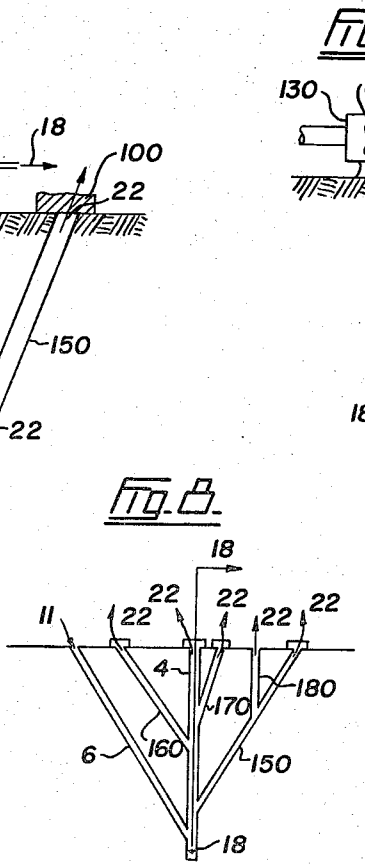

FIG. 8 shows a cluster of exhaust holes, all deriving from the original bore holes 4 and 6. Although naturally operating the exhaust holes could be provided with fans for example, 100 in FIG. 7, to complement or accelerate the heat induced by the passage of the hot gases against the surface of the exhaust hole while escaping. The amount of heat additionally used by applying this cluster of additional exhaust holes makes the recovery of melted tar more economic.

Figure 9:
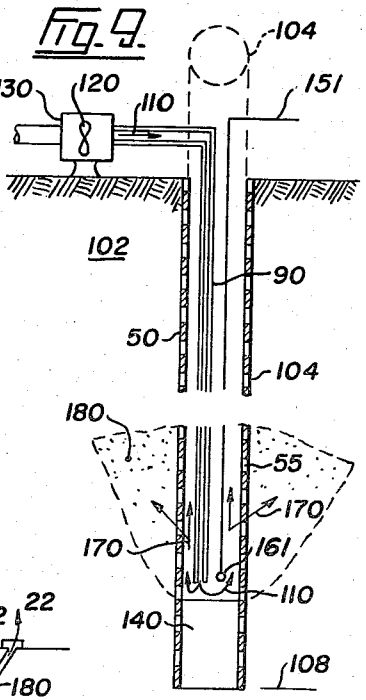
FIGS. 7 to 9 show steps in a further process according to the present invention.

FIG. 9 illustrates a process to be applied when the natural draft effect is not possible due to the great depth of the deposit. In FIG. 9 a single main bore hole 104 is formed to the desired depth 108. Using casing of the type illustrated in FIG. 5 a bore is formed in deposit 102. A solid tube 90 is lowered within the casing 60. The tube 90, constructed as the illustrated tube 50, is used to carry down the make up air required for the combustion. The tube 90 is insulated and provided with cooling coils. The make-up air 110 is forced down by a fan 120 supported by a structure 130.

FIG. 9 shows also inflammable liquid 140 lowered to the bottom of the casing 50 and a cable 151 to provide the flame 161 required to ignite the inflammable liquid and start the combustion process. After the combustion process is started the cable 151 is retracted. The hot combustion gases 170 rise by the flue effect with the casing 50 acting as the chimney. While ascending the hot gases 170 expand into the surface through the casing openings 55, melting the tar 181.

Figure 10:
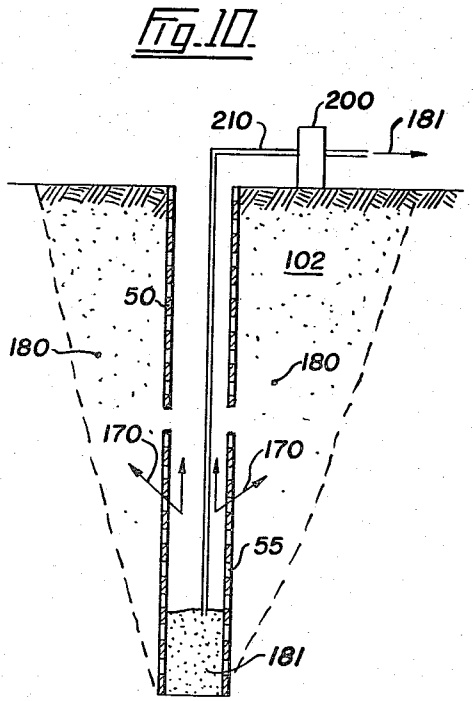

FIG. 10 illustrates a part of the process where the melted tar 180 is pumped out using a pump 200 acting through pipe 210.

The process of the present invention is simple and, in particular, avoids expensive injection and compression apparatus for the wells. As far as possible the method according to the present invention uses a natural draft created by combustion.

The preliminary ignition of the deposit may be by a gas or liquid. However, it will be appreciated that any known means for starting the combustion can be used. Once this is started the convection provides that the ignition is self-sustaining. It is envisaged that other methods of starting the fire include the use of a laser beam or the use of an atomic explosion.

The process of the present invention is applicable to artifically constructed deposits of tar sand, for example large mounds or piles formed of tar sand extracted from its natural position and piled on the ground.

It has been described above how the generation of steam in a bore hole can facilitate the extraction of the oil. It is particularly desirable that the steam be generated under pressure, first to overcome the pressure at the depths at which the oil is recovered and, secondly, to facilitate ingress of the steam into the deposit 102.

Figure 12:
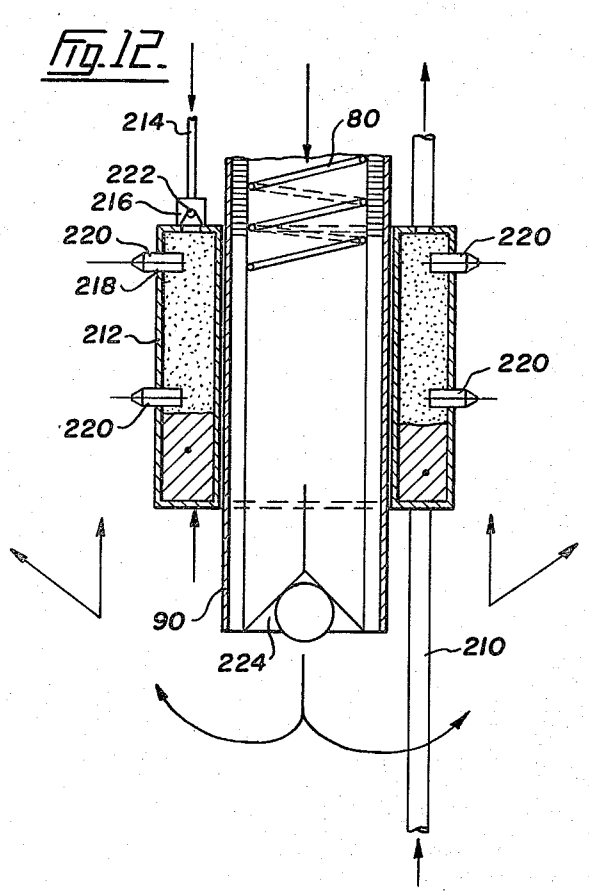
FIGS. 11 and 12 illustrate the generation of steam under pressure to assist in melting tar in a deposit.
Figure 11:
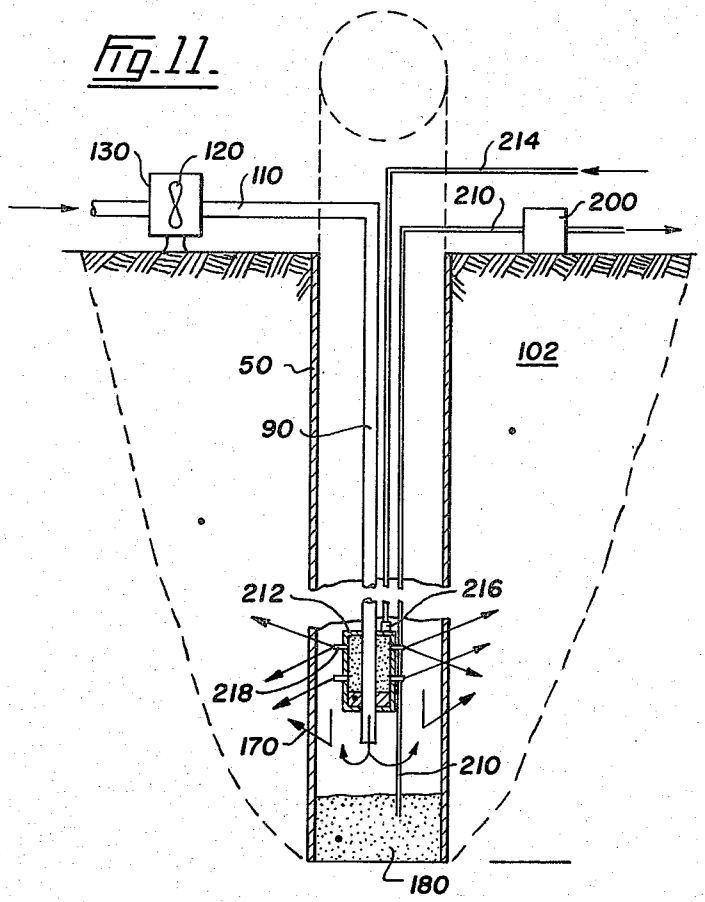

Accordingly, FIGS. 11 and 12 illustrate an apparatus comprising a vessel 212 surrounding the tube 90 within the casing 50. There is an inlet pipe 214 through which water is feed to the vessel 212. The water enters vessel 212 from the pipe 214 through an inlets 216. There are outlets 218 in the walls of the vessel 212. Each outlet 218 is controlled by a conventional pressure valve 220 to ensure that steam generated within the vessel 212 leaves the vessel 212 at a predetermined pressure. That pressure can be up to several thousand pounds per square inch but, generally, the release pressure will be determined first by the depth of the bore and, secondly, by the nature of the deposit to be penetrated by the steam.

In use water is fed down the inlet pipe 214. As it passes through the inlet pipe 214 it is heated by the exhaust gases leaving the deposit 102. It may be converted to steam in the pipe 214 but, in any event, is converted to steam within the vessel 212. When the steam pressure in vessel 212 reaches a certain level the release valve 220 positioned in each outlet 218 will release the steam in a high pressure jet that will penetrate and warm the oil in the deposit 102.

It is desirable that the inlets 216 through which the water passes through from water pipe 214 the vessel 212 be controlled by a check valve 222 so that water is not forced up the inlet pipe 214 against the desired flow direction.

The vessel 212 may be spaced from the tube 90 or, at least, be a slidable fit on tube 90 so that the vessel may be moved up and down the tube depending on the location of the combustion zone.

It is further desirable to provide a check valve 224 in the base of tube 90 to facilitate air flow to the combustion zone without back pressure from combustion gases. The check valve 224 is shown schematically in FIG. 12. Any known type of check valve able to withstand high temperature will suffice.

I claim:

1. A process for recovering a viscous, combustible material from a sub-surface deposit of the material comprising:

forming a substantially vertical, main bore into the deposit;

igniting the deposit adjacent the base of the bore;

arranging a supply of air to the ignition site whereby a self-sustaining combustion takes place in the bore supported by natural draft generated by the combustion and the gaseous products of the combustion can leave the bore, and where the heat of the combustion and of the gaseous products of the combustion liquid melt the material in the deposit; and extracting liquefied material from the bore.

2. A process as claimed in claim 1 in which the deposit is ignited by igniting an inflammable substance adjacent the base of the bore.

3. A process as claimed in claim 2 in which the inflammable substance is a liquid or a gas.

4. A process as claimed in claim 1 in which the ignition is started by a laser beam or by an explosion.

5. A process as claimed in claim 1 in which the ignition is started by electrical means.

6. A process as claimed in claim 1 in which the ignition is assisted during start up but stopped after the combustible material of the deposit has ignited.

7. A process as claimed in claim 1 in which the subsurface deposit of the material is a tar sand deposit comprised of large man-made mounds.

8. A process as claimed in claim 1 comprising forming one inclined bore hole to meet the main bore to provide the necessary supply of air to the ignition and to obtain a natural draft of inflow cool air and a natural chimney effect.

9. A process as claimed in claim 8 in which the casing used in the inclined bore that meets the substantially vertically main bore is made of resilient, insulated material that is provided with cooling means.

10. A process as claimed in claim 8 in which the original, vertical main bore is deepened further as the viscous combustible material in the deposit is extracted, forming a further inclined bore, meeting the main bore above its new base, and capping the said one inclined bore.

11. A process as claimed in claim 8 including forming further main bores in the deposit as the combustion proceeds through the deposit, each intersecting with an inclined bore hole above the base of the main bore, and capping the inclined bore so intersected.

12. A process as claimed in claim 8 comprising forming a further inclined bore, at least partially capping said main bore to use said further inclined bore as an exhaust.

13. A process as claimed in claim 12 comprising assisting the withdrawl of exhaust by the use of a fan cooperatively associated with each exhaust hole.

14. A process as claimed in claim 1 in which there is a combustion chamber formed in the main bore.

15. A process as claimed in claim 1 in which casing is used to maintain the main bore, said casing being of a perforate, heat-resistant resilient material to allow the melted material to flow through for recovery purposes.

16. A process as claimed in claim 1 in which water is supplied to the main bore to a vessel having perforate walls, the heat in the bore forming steam to assist in the melting of material.

17. A process as claimed in claim 1 comprising forming a single main bore then inserting into said main bore a pipe to carry down the cool air needed to sustain the combustion.

18. A process as claimed in claim 17 in which the pipe is imperforate and is insulated.

19. A method as claimed in claim 1 in which steam is generated in a vessel adjacent the base of the main bore by providing water through an inlet pipe down the bore to the vessel, the vessel having outlets, regulated by valves, to release the steam generated in the vessel at a predetermined pressure.

20. A method as claimed in claim 19 in which the inlet pipe feeds to the vessel through a check valve.

21. A method as claimed in claim 19 in which the vessel can be moved up and down in the bore.

22. A method as claimed in claim 1 including positioning a check valve to permit the supply of air to the ignition site without back pressure from the gaseous products of combustion.

* * * * *